US007233323B2

(12) United States Patent
Watsuda

(10) Patent No.: US 7,233,323 B2
(45) Date of Patent: Jun. 19, 2007

(54) DEVICE AND METHOD FOR VARYING THE ROW SCANNING TIME TO COMPENSATE THE SIGNAL ATTENUATION DEPENDING ON THE DISTANCE BETWEEN PIXEL ROWS AND COLUMN DRIVER

(75) Inventor: Hirofumi Watsuda, Kobe (JP)

(73) Assignee: TPO Hong Kong Holding Limited, Shatin (HK)

( * ) Notice: Subject to any disclaimer, the term of this patent is extended or adjusted under 35 U.S.C. 154(b) by 259 days.

(21) Appl. No.: 10/491,514

(22) PCT Filed: Oct. 3, 2002

(86) PCT No.: PCT/IB02/04063

§ 371 (c)(1),
(2), (4) Date: Apr. 2, 2004

(87) PCT Pub. No.: WO03/030136

PCT Pub. Date: Apr. 10, 2003

(65) Prior Publication Data

US 2004/0239604 A1 Dec. 2, 2004

(30) Foreign Application Priority Data

Oct. 3, 2001 (JP) ..... 2001-308019

(51) Int. Cl.
*G09G 5/00* (2006.01)

(52) U.S. Cl. ..... 345/204; 345/207; 345/212; 345/214

(58) Field of Classification Search ..... 345/90–100, 345/204, 212, 214, 58, 197, 87, 207, 46, 345/82, 630, 419, 502, 542, 596, 698, 646, 345/593, 572, 535; 359/85, 88, 54; 349/150; 382/128, 154

See application file for complete search history.

(56) References Cited

U.S. PATENT DOCUMENTS

| | | | | |
|---|---|---|---|---|
| 5,088,053 | A * | 2/1992 | Sprague et al. | 345/535 |
| 5,467,210 | A * | 11/1995 | Kishigami | 349/150 |
| 5,510,805 | A * | 4/1996 | Lee | 345/58 |
| 6,195,077 | B1 * | 2/2001 | Gyouten et al. | 345/99 |
| 6,456,266 | B1 * | 9/2002 | Iba et al. | 345/87 |
| 6,459,425 | B1 * | 10/2002 | Holub et al. | 345/207 |
| 6,753,873 | B2 * | 6/2004 | Dixon et al. | 345/542 |
| 6,803,989 | B2 * | 10/2004 | Silverbrook | 355/18 |
| 7,027,642 | B2 * | 4/2006 | Rubbert et al. | 382/154 |
| 2003/0133054 | A1 * | 7/2003 | Taguchi et al. | 349/38 |
| 2004/0252870 | A1 * | 12/2004 | Reeves et al. | 382/128 |

(Continued)

*Primary Examiner*—Bipin Shalwala
*Assistant Examiner*—Prabodh Dharia
(74) *Attorney, Agent, or Firm*—Birch, Stewart, Kolasch & Birch, LLP

(57) ABSTRACT

A display device having a control circuit for changing a time period of applying a signal voltage to each of the signal lines and a scanning voltage to each of the scanning lines within one vertical scanning period (T). The control circuit controls each of horizontal scanning periods ($t_1$ to $t_m$) in such a manner that the period is gradually increased from the scanning line located close to a vertical driving circuit to the scanning line located remote from the vertical driving circuit. In this way, when writing a signal voltage to a pixel via the signal lines, the target potential is reached at each pixel within the time period of applying the signal voltage.

5 Claims, 4 Drawing Sheets

U.S. PATENT DOCUMENTS

2005/0052477 A1* 3/2005 Kudo et al. ..... 345/690
2005/0210722 A1* 9/2005 Graef et al. ..... 40/452
2006/0187370 A1* 8/2006 Hoshino ..... 349/38

* cited by examiner

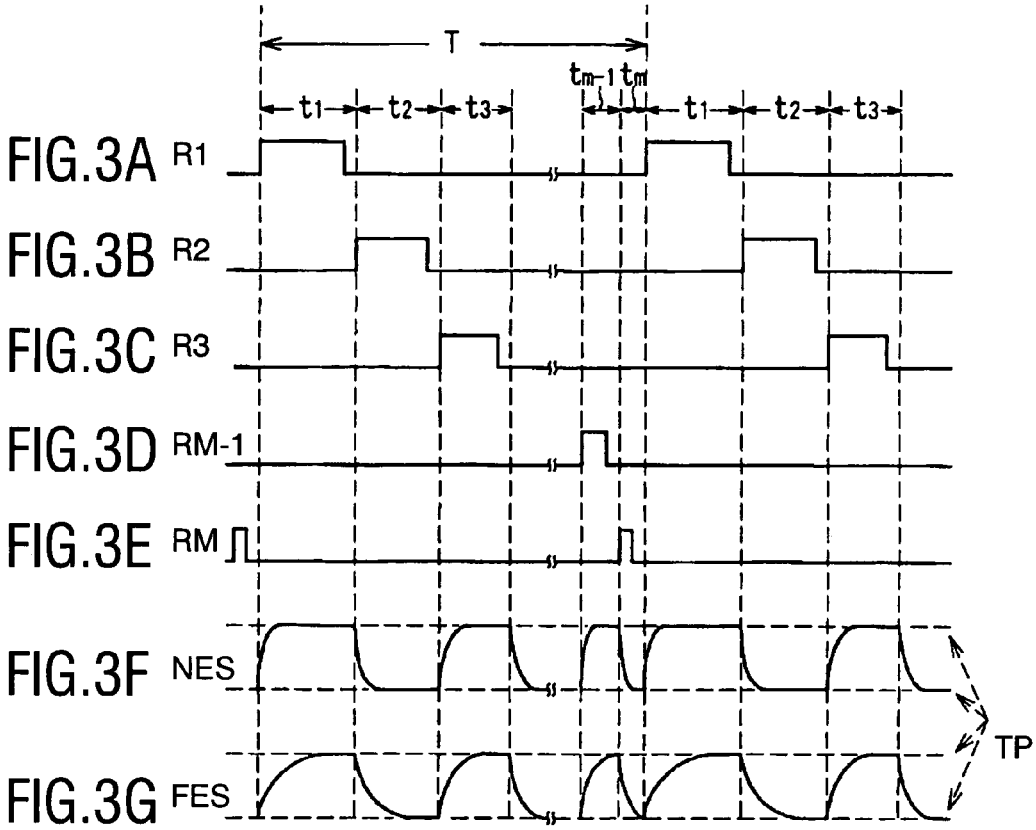
T
t1
t2
t3
tm-1
tm
t1
t2
t3
FIG.3A R1
FIG.3B R2
FIG.3C R3
FIG.3D RM-1
FIG.3E RM
FIG.3F NES
FIG.3G FES
TP

DEVICE AND METHOD FOR VARYING THE ROW SCANNING TIME TO COMPENSATE THE SIGNAL ATTENUATION DEPENDING ON THE DISTANCE BETWEEN PIXEL ROWS AND COLUMN DRIVER

BACKGROUND OF THE INVENTION

The present invention relates to a display device comprising:

- a matrix of rows and columns of pixels,
- a group of first wires, each first wire coupled to a respective one of the rows of pixels,
- a group of second wires, each second wire coupled to a respective one of the columns of pixels,
- first voltage applying means for applying a scanning voltage to each of the first wires successively and
- second voltage applying means for applying respective signal voltages to each of the second wires in synchronization with the scanning voltage successively applied to the first wires.

In recent years, electronic devices equipped with flat panel displays such as a liquid crystal display (hereinafter referred to as "LCD"), a plasma display panel (PDP), a field emission display (FED) and an organic EL (electroluminescence) display as display devices are becoming widespread rapidly. Above all, the widespread use of electronic devices equipped with LCDs is remarkable and they cover a fairly broad spectrum of applications.

Examples of LCDs include so-called active matrix type LCDs using thin film transistors hereinafter referred to as "TFTs". These TFTs make it possible to implement an LCD provided with multiple scanning lines as, for example, required for large screen or high definition displays, with excellent display performance such as contrast and on/off response. Such an active matrix type LCD generally comprises an array of pixels arranged in a matrix of horizontal and vertical lines. Horizontal lines are also called scanning lines or rows; vertical lines are also called signal lines or columns. Driving circuits are provided for both the horizontal and vertical lines, and each pixel is provided with a TFT as a switching element. In this LCD, the horizontal driving circuit cyclically supplies a sequential scanning voltage to the scanning lines for driving TFTs line by line in sequence, while the vertical driving circuit, operating in synchronization with the horizontal driving circuit, selectively supplies signal voltages to the signal lines according to an image signal. In this way, pixels are selected through the scanning lines one row of pixels at a time from top to bottom. Signal voltages are applied to each of the respective electrodes of the pixels on the selected scanning line via the corresponding signal lines in a sequential manner. The signal voltages are written at the respective electrodes of the pixels and an image is displayed on the display panel. Thus, within a period during which one scanning line is selected, hereinafter also referred to as "horizontal scanning period", the signal voltages are supplied to the pixels corresponding to the scanning line.

However, since the signal lines are normally made of a conductive material, the above-mentioned conventional LCD has a problem that a time constant of the signal line affects the display performance of the LCD. This often becomes problematic especially in such a case as a large display and a high definition display.

FIG. 4 is a timing chart when a voltage is applied to each pixel of the conventional LCD. FIGS. 4A to 4E illustrate signals on the scanning lines of the first to third rows R1, R2, R3, the (M-1)th row RM-1 and the Mth row RM and FIG. 4F illustrates a signal, indicated by NES, of an arbitrary signal line close to the horizontal driving circuit and FIG. 4G illustrates a signal, indicated by FES, of a signal line remote from the horizontal driving circuit. As shown in FIGS. 4A to 4E, the horizontal scanning period t is the time period allocated to each line for scanning this line. During a vertical scanning period T the selection of all scanning lines is completed once. For this reason, if the time constant increases, the signal voltages, while writing pixels on the nearer end side NES close to the vertical driving circuit, reach still the target potential TP during the horizontal scanning period t as shown in FIG. 4F, whereas for pixels on the farther end side FES remote from the vertical driving circuit, the waveforms of the signal voltages applied to the signal lines become less steep and the signal voltages do not reach the target potential TP within the horizontal scanning period t, making it difficult to write correct signal voltages to the pixels. This would lead to deterioration of the display performance of the device such as brightness deviations.

A possible way to solve this problem is to lengthen each horizontal scanning period t. However, simply lengthening each horizontal scanning period t means lengthening the vertical scanning period T, which would lead to deterioration of display quality due to flickering.

SUMMARY OF THE INVENTION

It is an object of the present invention to provide a display device capable of writing the signal voltages under the condition that the signal voltages of all pixels can reach a desired potential without changing the vertical scanning period as compared to the prior art. The invention is defined by the independent claims. The dependent claims define advantageous embodiments.

A display device of the present invention is characterized by further comprising a period changing means for changing a time period of applying the signal voltage in dependence on a distance between a row of pixels and the second voltage applying means. It should be noted that a "pixel" in the present invention includes the component associated with that pixel. The terms "rows of pixels" and "columns of pixels" are used to identify two sets of pixels, which are generally, substantially perpendicular to each other, so the terms "rows" and "columns" are interchangeable. In the display device of the present invention, the time period of applying the signal voltage to each pixel through each of the second wires can be set to any value. Therefore, the display device of the present invention can control the voltage application period in such a manner that the period of time of applying a voltage to each pixel is extended for pixels coupled to second wires where it is difficult to reach a target potential.

The period changing means more specifically selects the time period of applying the signal voltage to be longer when the signal distance between a row of pixels and the second voltage applying means increases. Furthermore, it is effective for the period changing means to control so that the period of time of applying a voltage to corresponding pixels through each of the second wires is gradually extended from the farther end side to the nearer end side of each of the second wires.

It is preferable for the period changing means to change the time period of applying a scanning voltage to each of the first wires in synchronization with the time period of applying a signal voltage to a pixel through each of the second wires. In this way it is possible to easily control the voltage application timing of both the first and second groups of wires.

Another display device of the present invention is characterized by further comprising a period changing means for changing each time period of applying a voltage to each of the first wires within a fixed cycle during which applying voltages to all the first wires is completed. This display device of the present invention also allows the period changing means to set each time period of applying a voltage to each of the first wires to any value. Therefore, it is possible to control the voltage application time in such a manner that the time period of applying a voltage to the first wires is extended in an area of the group of second wires where it is difficult to supply a voltage from the second voltage applying means and it is difficult to reach a target potential.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and in which:

FIG. 3 is a timing chart for explaining an operation of the LCD shown in FIG. 1.

DESCRIPTION OF THE PREFERRED EMBODIMENT(S)

Figure 1:
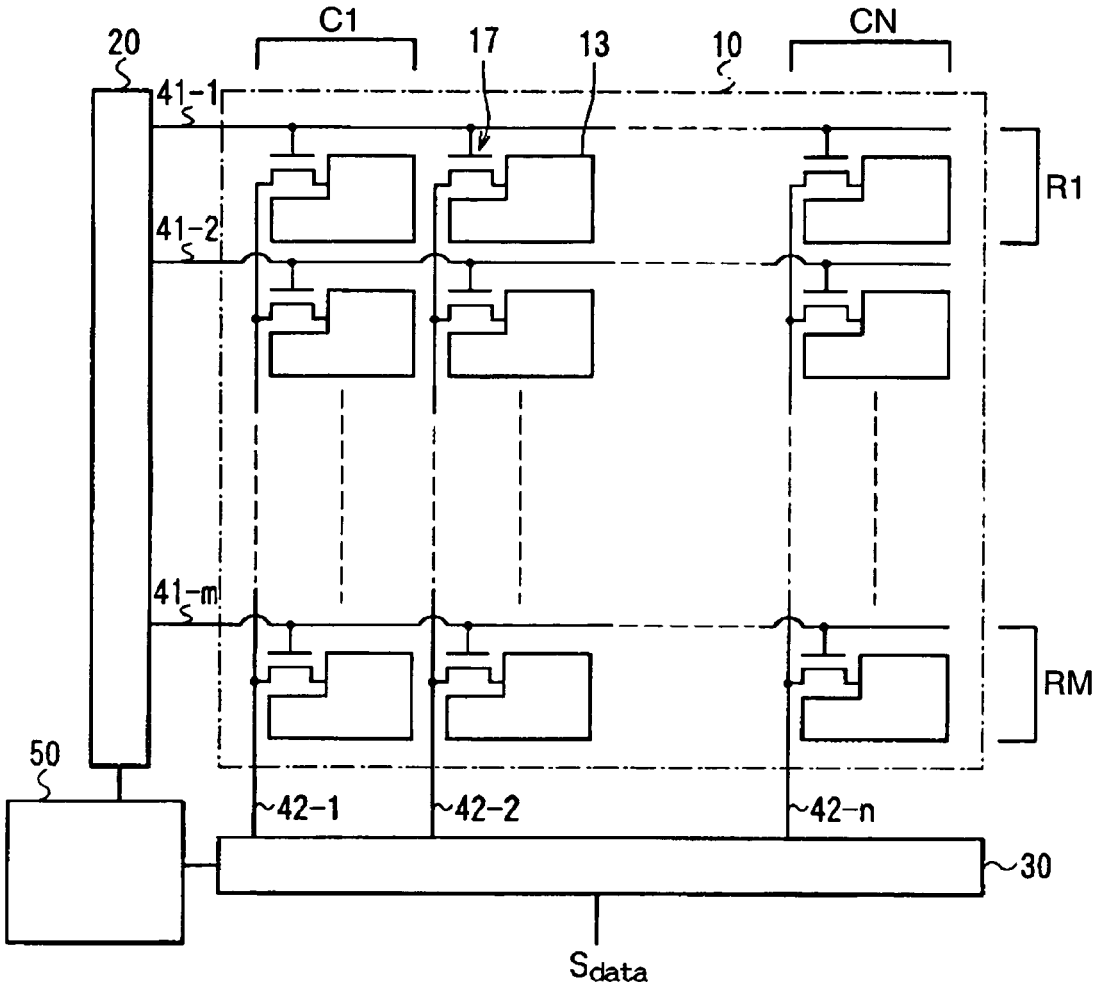
FIG. 1 is a schematic view showing a general structure of an LCD according to an embodiment of the invention.

FIG. 1 is a schematic view showing an LCD according to an embodiment of the invention. This LCD comprises a liquid crystal panel 10 having an array of pixels arranged in, for example, an M×N matrix and a horizontal driving circuit 20 and a vertical driving circuit 30, provided as a first and a second voltage applying means, placed peripheral to the liquid crystal panel 10.

Figure 2:
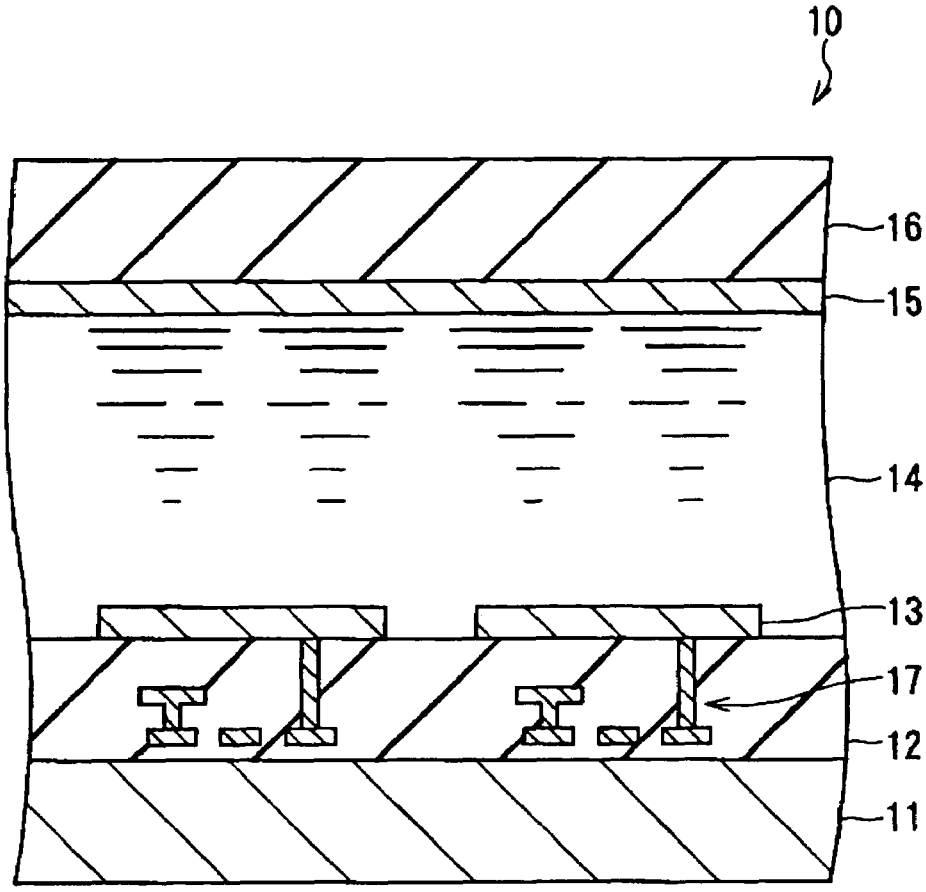
FIG. 2 is a sectional view taken along a line II—II of FIG. 1.
Figures 4A, 4B, 4C, 4D, 4E, 4F, 4G:
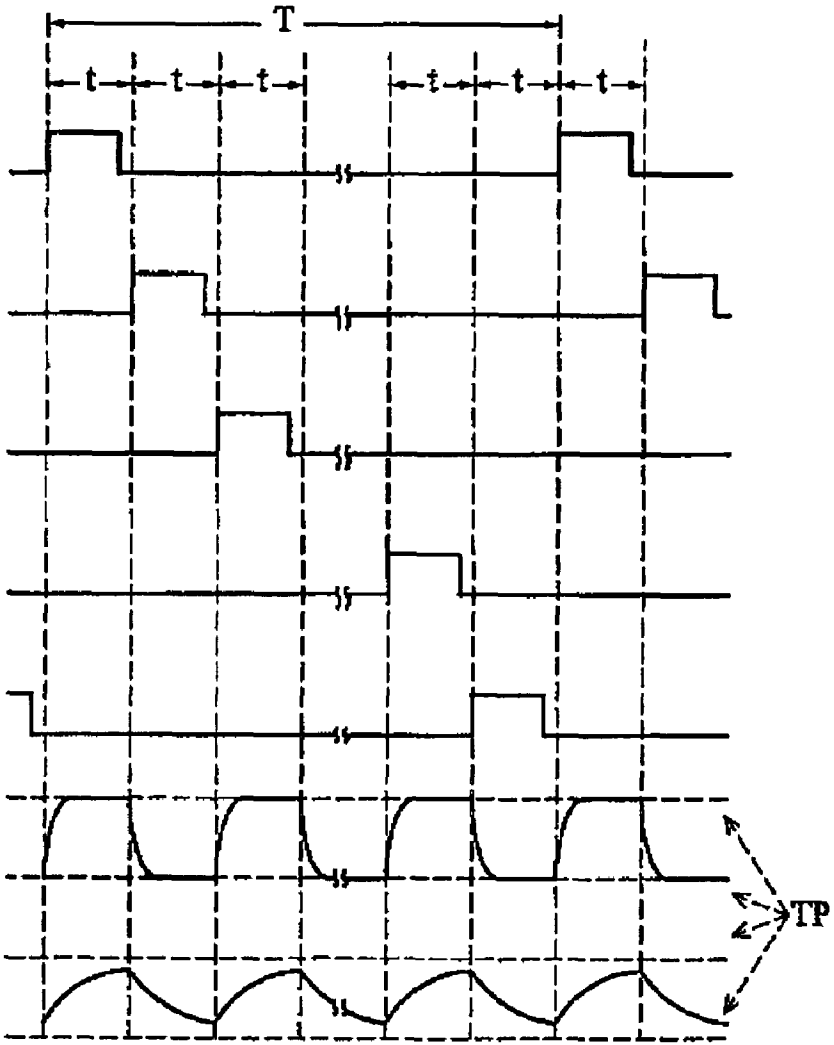
FIG. 4A (RELATED ART)
FIG. 4B (RELATED ART)
FIG. 4C (RELATED ART)
FIG. 4D (RELATED ART)
FIG. 4E (RELATED ART)
FIG. 4F (RELATED ART)
FIG. 4G (RELATED ART)
FIG. 4 is a timing chart for explaining an operation of an LCD according to the related art.

FIG. 2 shows an exemplary sectional structure of the liquid crystal panel 10. The liquid crystal panel 10 is provided with a driving substrate 11 on which a plurality of pixel electrodes 13 are formed through an insulating layer 12 and an opposite substrate 16 which is placed to oppose the driving substrate 11 with a given space in between and on the driving substrate side of which a common electrode 15 and a color filter (not shown) are provided. A liquid crystal layer 14 is held between the driving substrate 11 and the opposite substrate 16. The pixel electrodes 13 are arranged for respective pixels in, for example, an M×N matrix and are electrically connected to, for example, drain electrodes of the TFTs 17, provided as switching elements, formed inside the insulating layer 12 in a one-to-one correspondence with the pixel electrodes 13. It is possible to use for the TFTs 17, either TFTs of a so-called top gate type or bottom gate type.

The gate electrodes of the TFTs 17 are arranged in a matrix corresponding to the pixel matrix. The pixel electrodes 13 are electrically connected row by row to the scanning lines constituting the first wires. M scanning lines 41-1 to 41-m (FIG. 1) constitute the group of first wires. The source electrodes of the TFTs 17 are electrically connected column by column to signal lines which constitute the second wires, while N signal lines 42-1 to 42-n constitute the group of second wires.

The horizontal driving circuit 20 is provided here on the signal line 42-1 side of the first column C1. This horizontal driving circuit 20 has the function of selecting a row to be driven and applies sequentially a scanning voltage, hereinafter also called gate voltage, to each scanning line 41-1 to 41-m of the group of scanning lines. More specifically, the horizontal driving circuit 20 supplies sequentially one scanning pulse in one cycle as the scanning voltage to each scanning line connected to the gate electrodes of the TFTs 17 of the corresponding row. One vertical scanning period corresponds to one cycle.

The vertical driving circuit 30 is provided here on the Mth scanning line 41-m side of the panel. This vertical driving circuit 30 has the function of selecting a column to be driven and receives an image signal $S_{data}$ from a voltage circuit (not shown) for converting the received image signal $S_{data}$ to signal voltages to be applied to the respective signal lines 42-1 to 42-n.

The LCD is further provided with a control circuit 50 for changing the time periods of applying the signal voltages to the signal lines and applying the gate voltages to the scanning lines within one vertical scanning period, during which applying the signal voltages to all the scanning lines is completed. The control circuit 50 of this embodiment controls each of the horizontal scanning periods so that the horizontal scanning period is gradually increased from the scanning line located closest to the vertical driving circuit 30, which is the Mth scanning line 41-m, to the scanning line located furthermost from the vertical driving circuit 30, which is the first scanning line. 41-1. The control circuit 50 controls each of the voltage application periods so that the time period of applying the signal voltage to rows of pixels via the signal lines, is gradually increased from the nearer end side to the farther end side. Here, the control circuit 50 corresponds to a specific example of the "period changing means" of the present invention.

The operation of this LCD will be explained with reference to FIG. 3. The vertical scanning period is indicated by T. FIG. 3 is a timing chart showing the timing of voltages applied to pixels in the LCD according to this embodiment.

In the LCD according to this embodiment, as shown in FIG. 3A, a sequential scanning voltage is applied to the first scanning line 41-1 for a horizontal scanning period $t_1$ through the horizontal driving circuit 20 and this sequential scanning voltage is supplied to the gate electrodes of the TFTs 17 present in the first row of pixels. At this time, each TFT 17 of the first row of pixels is turned on and the TFT is made conductive between its source electrode and its drain electrode. As described above, since the selection period, being the voltage application period, of the first scanning line 41-1 within one vertical scanning period T is the longest among the M scanning lines, the horizontal scanning period $t_1$ is at least longer than T/M.

After completion of the horizontal scanning period $t_1$, as shown in FIG. 3B, a sequential scanning voltage is applied to the second scanning line 41-2 during a horizontal scanning period $t_2$, which is shorter than the period $t_1$. As in the case of the first scanning line 41-1, this allows the sequential scanning voltage to be supplied to the gate electrodes of the TFTs 17 present in the second row of pixels and the TFTs 17 in the second row are turned on.

Then, the respective sequential scanning voltages are likewise sequentially applied to the scanning lines 41-3 to 41-m from the third row 41-3 onward for horizontal scanning periods satisfying $t_2>t_3 \ldots >t_m$ and $t_1+t_2+ \ldots + t_{m-1}+t_m=T$ as shown in FIGS. 3C to 3E.

On the other hand, the signal voltages according to the image signal are supplied to the respective signal lines 42-1 to 42-n for one vertical scanning period T through the vertical driving circuit 30. When the TFTs 17 are turned on, the signal voltages at that time are supplied to the corresponding pixel electrodes 13 through the corresponding TFTs 17. As a result, the signal voltages are applied to those parts of the liquid crystal layer 14 which are present between the common electrode 15 and the pixel electrodes 13 supplied with the signal voltages, so that the liquid crystal layer 14 is driven and an image is displayed on the liquid crystal panel.

FIGS. 3F and 3G show exemplary signal voltage waveforms of the nearest end side NES and farthest end side FES of the first signal line 42-1, respectively. Here, during a certain vertical scanning period T, the control circuit 50 controls each horizontal scanning period so that the horizontal scanning period is gradually shortened from the first scanning line 41-1 located furthermost from the vertical driving circuit 30 to the Mth scanning line 41-m. The control circuit 50 controls each signal voltage application period in such a way that the time period of applying the signal voltage is increased from the nearest end side NES to the farthest end side FES of the signal lines 42-1 to 42-n. Therefore the pixels on the first R1 and second rows R2, etc. are not affected by the time constants of the signal lines. Thus, when a scanning line far from the vertical driving circuit 30 is selected, it takes a relatively long time for the signal voltage supplied by the vertical driving circuit 30 to the area of the corresponding pixels of the signal line to reach a target value. But since a longer horizontal scanning period is set for such a scanning line, the target voltage still can be reached, meaning that the signal voltage is written at the pixel electrode 13 with the correct target voltage. This makes it possible to obtain an image of excellent quality without brightness deviations, color variations, flickering or other artifacts. Moreover, since TFTs 17 for the pixels on the farther end side of the signal lines 42-1 to 42-n are in the on state for a longer time than those on the their nearer end side NES, the pixel electrodes 13 for the pixels on the farther end side FES of the signal lines achieve the respective target voltages even if an output current capability of a driving circuit is low and it takes a longer time to charge the farther end side FES of the signal lines. Therefore, a large driving capability is unnecessary for the vertical driving circuit 30 in this embodiment. Consequently, the vertical driving circuit 30 requires less power.

With the LCD according to this embodiment, since the control circuit 50 is adapted for changing each of the time periods of applying the gate voltage to the respective scanning lines within the fixed vertical scanning period and changing the time period of applying the voltage to the pixels between the nearer end side and the farther end side, the time period of applying a voltage to the scanning line corresponding to that area of the signal line for which it takes a relatively long time for the supplied signal voltage to reach a target value, can be lengthened. Therefore, the signal voltage can be written at the pixel electrode 13 with the target voltage being reached, thereby improving the display performance of the device.

In addition, by adapting the time periods of applying the signal voltages to the pixels so as to be longer at the nearer end side of the signal line than at the farther end side of the signal line, the voltage supplied to any pixel electrodes 13 reaches a target voltage even if the driving capability of the vertical driving circuit 30 is lowered. This leads to a device with reduced power consumption.

Although the present invention has been explained with the embodiment thereof, the present invention is not limited to the above embodiment but can also be implemented in various modifications. For example, the above embodiment has described the case where the vertical driving circuit 30 is provided on the Mth scanning line 41-m side of the liquid crystal panel, but the vertical driving circuit 30 may be provided on the first scanning line 41-1 side of the panel. In addition, the vertical driving circuit 30 may be provided on the same side of the liquid crystal panel as the horizontal driving circuit 20 to obtain a so-called narrow frame display device.

The above embodiment has described the case where there is no so-called vertical blanking interval, but it goes without saying that the effects of the present invention can also be obtained when there is a vertical blanking interval.

The above embodiment has described the case where the control circuit 50 controls each horizontal scanning period so that the horizontal scanning period and signal voltage application period change gradually, but these periods need not always to increase gradually and the control circuit 50 may control each signal voltage application period so that the signal voltage application period of the farther end side located remote from the vertical driving circuit 30 becomes longer than the signal voltage application period of the nearer end side. Alternatively, the control circuit 50 may control each signal voltage application period so that the horizontal scanning period of the scanning line located remote from the vertical driving circuit 30 becomes longer than horizontal scanning period of the scanning line located close to the vertical driving circuit 30.

The above embodiment has described the case where the control circuit 50 controls both the horizontal scanning periods and signal voltage application periods, but the effects of the present invention can also be obtained when the control circuit controls only one of the horizontal scanning periods or signal voltage application periods.

The above embodiment has described the case where the scanning lines are scanned in a line-sequential manner, but the present invention is also applicable to a case where the scanning lines are scanned in a point-sequential manner.

In the above embodiment, the TFTs 17 are used as switching elements, but it is also possible to use other switching elements such as MOSFETs (metal oxide semiconductor field effect transistor). Furthermore, the above embodiment has described the case of a so-called active matrix drive type device using switching elements, but the present invention is also applicable to a so-called passive matrix drive type device without using any switching elements.

The above embodiment has described the case where a color filter (not shown) is formed on the opposite substrate 16, but the color filter need not always be formed.

Furthermore, the above embodiment has described an LCD as an example of the display device, but the present invention is widely applicable to other display devices having an array of pixels arranged in a matrix. Such display devices include a plasma display, field emission display and organic EL display.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A display device comprising: a matrix of rows and columns of pixels;

a group of first wires, each first wire coupled to a respective one of the rows of pixels;

a group of second wires, each second wire coupled to a respective one of the columns of pixels;

first voltage applying means for applying a scanning voltage to each of the first wires successively; and second voltage applying means for applying respective signal voltages to each of the second wires in synchronization with the scanning voltage successively applied to the first wires, characterized in that the display device further comprises a period changing means for changing a time period for initiaiting application of the signal voltage depending on a distance between a row of pixels and the second voltage applying means.

2. A display device as claimed in claim 1, characterized in that the period changing means changes a time period of applying the scanning voltage to each of the first wires in synchronization with the time period of applying the signal voltage to each of the second wires.

3. A display device as claimed in claim 1, characterized in that the period changing means selects the time period of applying the signal voltage to be longer when the signal distance between a row of pixels and the second voltage applying means increases.

4. A display device as claimed in claim 1, characterized in that applying scanning voltages to all the first wires is completed within a predetermined period time.

5. A method of driving a display device comprising a matrix of rows and columns of pixels, a group of wires with each wire coupled to a respective one of the rows of pixels, a group of second wires with each wire coupled to a respective one of the columns of pixels, and a driver stage for driving the group of second wires, the method comprising the steps of:

applying successively a scanning voltage to each of the first wires; and applying signal voltages to each of the second wires in synchronization with the scanning voltage applied to the first wires, characterized in that time period for initiating application of the scanning signal is changed in depending on a distance between a row of pixels to which the scanning signal is applied and the driver stage.

* * * * *